US009543717B2

(12) United States Patent
Sun et al.

(10) Patent No.: US 9,543,717 B2
(45) Date of Patent: Jan. 10, 2017

(54) COMMUNICATION CONNECTOR WITH AN ELASTIC INNER CONDUCTOR

(71) Applicant: ZTE Corporation, Shenzhen, Guangdong (CN)

(72) Inventors: Wei Sun, Shenzhen (CN); Xiangwen Wu, Shenzhen (CN); Yiyun Bao, Shenzhen (CN)

(73) Assignee: ZTE CORPORATION, Shenzhen, Guangdong (CN)

( * ) Notice: Subject to any disclaimer, the term of this patent is extended or adjusted under 35 U.S.C. 154(b) by 0 days.

(21) Appl. No.: 14/419,870

(22) PCT Filed: Jul. 18, 2013

(86) PCT No.: PCT/CN2013/079624

§ 371 (c)(1),
(2) Date: Feb. 5, 2015

(87) PCT Pub. No.: WO2014/029246

PCT Pub. Date: Feb. 27, 2014

(65) Prior Publication Data

US 2015/0207277 A1 Jul. 23, 2015

(30) Foreign Application Priority Data

Aug. 20, 2012 (CN) ..... 2012 2 0413155 U

(51) Int. Cl.
*H01R 12/00* (2006.01)
*H01R 24/46* (2011.01)
(Continued)

(52) U.S. Cl.
CPC ..... *H01R 24/46* (2013.01); *H01R 13/111* (2013.01); *H01R 13/7033* (2013.01); *H01R 2103/00* (2013.01)

(58) Field of Classification Search
CPC ..... H01R 2103/00; H01R 24/46; H01R 24/50
(Continued)

(56) References Cited

U.S. PATENT DOCUMENTS 3,946,390 A 3/1976 Alexander
4,600,263 A * 7/1986 DeChamp ..... H01R 24/40 439/585

(Continued)

FOREIGN PATENT DOCUMENTS

CN 1340885 A 3/2002
CN 202759060 U 2/2013

(Continued)

OTHER PUBLICATIONS

International Search Report in international application No. PCT/CN2013/079624, mailed on Oct. 31, 2013.

(Continued)

*Primary Examiner* — Phuong Dinh
(74) *Attorney, Agent, or Firm* — Oppedahl Patent Law Firm LLC

(57) ABSTRACT

A connector comprises an inner conductor (1) and an outer conductor (2); an insulating medium (3) is provided between the inner conductor and the outer conductor, the insulating medium forming an unclosed cavity, and an opening of the unclosed cavity being a port for termination. The inner conductor comprises a first inner conductor (40) and an elastic inner conductor (60), the first inner conductor and the elastic inner conductor being disposed in the unclosed cavity; the elastic inner conductor (60) comprises an elastic member (61) having an inclinedly oriented free end portion (611) and a protrusion (612) projecting towards the first inner conductor (40); in the case where the connector is unterminated, the protrusion of the elastic inner conductor contacts the first inner conductor, and in the case where the (Continued)

connector is terminated, the inclinedly oriented free end portion (611) is moved substantially laterally by a terminating conductor (50) vertically inserted through the port for termination, such that the protrusion (612) is separated from the first inner conductor (40) and the terminating conductor (50) is in contact with the elastic inner conductor (60). The connector solves the problem of a complex connector structure caused by separation of a performance transmission device and an elastic device of a connector in the prior art.

11 Claims, 5 Drawing Sheets

(51) Int. Cl.
*H01R 13/11* (2006.01)
*H01R 13/703* (2006.01)
*H01R 103/00* (2006.01)

(58) Field of Classification Search
USPC ..... 439/63, 188; 200/51.1
See application file for complete search history.

(56) References Cited

U.S. PATENT DOCUMENTS 4,633,048 A 12/1986 Komatsu
6,520,785 B2 2/2003 Hida
6,533,593 B1 3/2003 Ishii
6,659,784 B1 * 12/2003 Klein ..... H01R 24/46 200/51.1
6,790,047 B2 * 9/2004 Togashi ..... H01R 24/50 439/188
2002/0025707 A1 2/2002 Hida

FOREIGN PATENT DOCUMENTS

EP 1041680 A2 10/2000
EP 1158627 A1 11/2001
EP 1187267 A2 3/2002
EP 1630906 A2 3/2006
JP 61116086 A 6/1986
JP 06124739 A 5/1994
JP 2002075554 A 3/2002
JP 2002531926 A 9/2002
JP 2006066281 A 3/2006

OTHER PUBLICATIONS

English Translation of the Written Opinion of the International Search Authority in international application No. PCT/CN2013/079624, mailed on Oct. 31, 2013.
Supplementary European Search Report in European application No. 13831172.5, mailed on Jun. 15, 2015.

* cited by examiner

COMMUNICATION CONNECTOR WITH AN ELASTIC INNER CONDUCTOR

TECHNICAL FIELD

The disclosure relates to the field of communication, more particularly relates to a connector.

BACKGROUND

With the rapid development of modern mobile communication technology, a new requirement for functions of a connector associated with mobile communication is put forward. For example, there may be a plurality of external input ports or external output ports in an integrated signal transmission system, and a corresponding connector is required for mating by each of the external input ports and the external output port, in order to ensure the signal transmission. In addition, when one of the external input ports and the external output ports is not in use, a corresponding load is also required for absorbing escaping signal in order to prevent interference of the escaping signal. However, absorbing the escaping signal by the corresponding load will increase the volume of the overall structure, and will significantly increase the manufacture cost. In general, a switch connector can be used for preventing interference of the escaping signal. A common switch connector in the prior art is described below.

FIG. 1 is a structural schematic diagram of a switch connector in the prior art. As shown in FIG. 1, the connector includes an inner conductor 11, an inner conductor 12 and an inner conductor 13. The connector is also provided with a pressure ring 14 and a spring 15. In particular, in the case where the connector is unterminated, the inner conductor 11 is not in contact with the inner conductor 12 and in an open state, while the inner conductor 12 is in contact with the inner conductor 13 by the pressure ring 14 and in a close state. In particular, in the case where the connector is terminated, due to the spring 15, the inner conductor 11 and the pressure ring 14 are pushed downward by a force produced by an interface fit. The inner conductor 11 is in contact with the inner conductor 12 and in a close state, while the inner conductor 12 is separated from the inner conductor 13 and in an open state. The inner conductor 11, the inner conductor 12, the inner conductor 13, the pressure ring 14 and the spring 15 operate together for port selection. The connector being unterminated means that there is no load connected to a connector port, and correspondingly, the connector being terminated means that there is a load connected to the connector port. However, in FIG. 1, a selective contact elastic device and the three inner conductors for accomplishing performance transmission are two separate systems, which result in complex structure of the entire connector, miscellaneous small parts, and difficult assembly and performance adjusting.

There is no efficient solution for solving the problem of complex structure of the connector due to the separation of the performance transmission device and the elastic device of the connector in the prior art.

SUMMARY

In view of this, an object of the disclosure is to provide a connector which prevents the problem of complex structure of the connector due to the separation of the performance transmission device and the elastic device of the connector.

To this end, a technical solution of an embodiment of the disclosure is realized as follows.

An embodiment of the disclosure provides a connector including an inner conductor, an outer conductor and an insulating member located between the inner conductor and the outer conductor and forming a non-closed cavity. An area at an opening of the non-closed cavity is a port for termination. The inner conductor includes a first inner conductor and an elastic inner conductor, wherein: the first inner conductor and the elastic inner conductor are arranged in the non-closed cavity; the elastic inner conductor comprises an elastic member having an inclinedly oriented free end portion and a protrusion projecting towards the first inner conductor; and in the case where the connector is unterminated, the protrusion of the elastic inner conductor is selectively in contact with the first inner conductor, and in the case where the connector is terminated, the inclinedly oriented free end portion is moved substantially laterally by a terminating conductor vertically inserted through the port for termination, such that the protrusion is separated from the first inner conductor and the terminating conductor is in contact with the elastic inner conductor.

In the above solution, in the case where the connector is terminated, the terminating conductor may move towards the first inner conductor and the elastic inner conductor in a vertical direction of the first inner conductor and the elastic inner conductor, until the elastic inner conductor is separated from the first inner conductor and in contact with the terminating conductor.

In the above solution, in the case where the connector is unterminated, the inclinedly oriented free end portion of the elastic member may be located below the port for termination, such that the terminating conductor, when being introduced, firstly contacts an inclined surface of the free end portion.

In the above solution, in the case where the connector is terminated, the terminating conductor may be subjected to an external force, and the elastic inner conductor may be changed from a first state into a second state. In the first state, the elastic member is in contact with the first inner conductor, and in the second state, the elastic member is separated from the first inner conductor and in contact with the terminating conductor.

In the above solution, the inclinedly oriented free end portion may be increasingly far away from the first inner conductor in a direction towards the port for termination.

In the above solution, the elastic inner conductor may include a first inner conductor section, a second inner conductor section and a third inner conductor section. The first inner conductor section may be inclinedly oriented. The second inner conductor section may be horizontally oriented. The third inner conductor section may be vertically oriented. One end of the second inner conductor section may be connected to the bottom end of the first inner conductor section, and the other end of the second inner conductor section may be connected to the top end of the third inner conductor section.

In the above solution, the first inner conductor may include a fourth inner conductor section, a fifth inner conductor section and a sixth inner conductor section. The fourth inner conductor section and the sixth inner conductor section may be vertically oriented, and the fifth inner conductor section may be horizontally oriented. One end of the fifth inner conductor section may be connected to the bottom end of the fourth inner conductor section, and the other end of the fifth inner conductor section may be connected to the top end of the sixth inner conductor section.

In the above solution, the insulating member may include a first insulator, a second insulator and a third insulator. The first insulator may be located outside the first inner conductor section, and the second insulator may be located outside the second inner conductor section and the third inner conductor section.

Preferably, the first insulator may be located outside the fourth inner conductor section, and the third insulator may be located outside the fifth inner conductor section and the sixth inner conductor section.

In the above solution, the insulating member may be manufactured by mould processing.

In the above solution, the connector may be a radio frequency coaxial switch connector.

In the above solution, a passage may be provided at the protrusion of the elastic member, and in the case where the connector is terminated, the terminating conductor may be inserted through the passage.

In the above solution, the protrusion of the elastic member may be formed by a pair of legs, and the passage may be formed by a gap between the pair of legs.

In the embodiment of the disclosure, the connector includes the elastic inner conductor and the first inner conductor. The elastic inner conductor selectively in contact with the first inner conductor or the terminating conductor solves the problem of complex structure of the connector due to the separation of the performance transmission device and the elastic device of the connector in the prior art. Furthermore, the performance transmission device integrated with the elastic device in the connector according to an embodiment of the disclosure results in less challenging part processing and finished product assembly, a simple structure, an apparent transmission route and a reliable performance, and also effectively prevents the interference of the escaping signal.

DETAILED DESCRIPTION

Technical solutions of the disclosure are described in detail below in connection with the drawings and specific embodiments. It should be noted that embodiments and features therein in this application can be combined with each other when they are compatible.

In the prior art, inner conductors of a connector are not made of elastic material, and the contact between the inner conductors is accomplished by springs. In other words, the performance transmission device of the connector is separated from the elastic device in the prior art, thereby a structure of the connector is complex. In view of this, a connector is provided by the disclosure, and the structure of the connector is described below.

Figure 1:
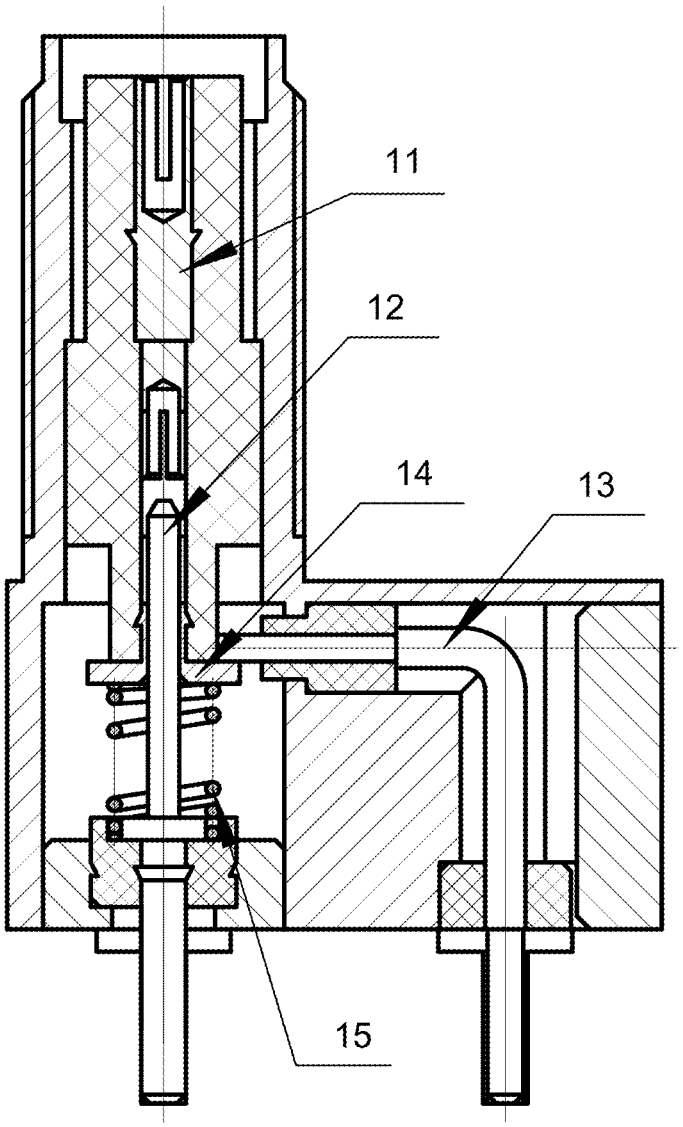
Fig. 1 Prior Art
FIG. 1 is a structural schematic diagram of a switch connector in the prior art.
Figure 2:
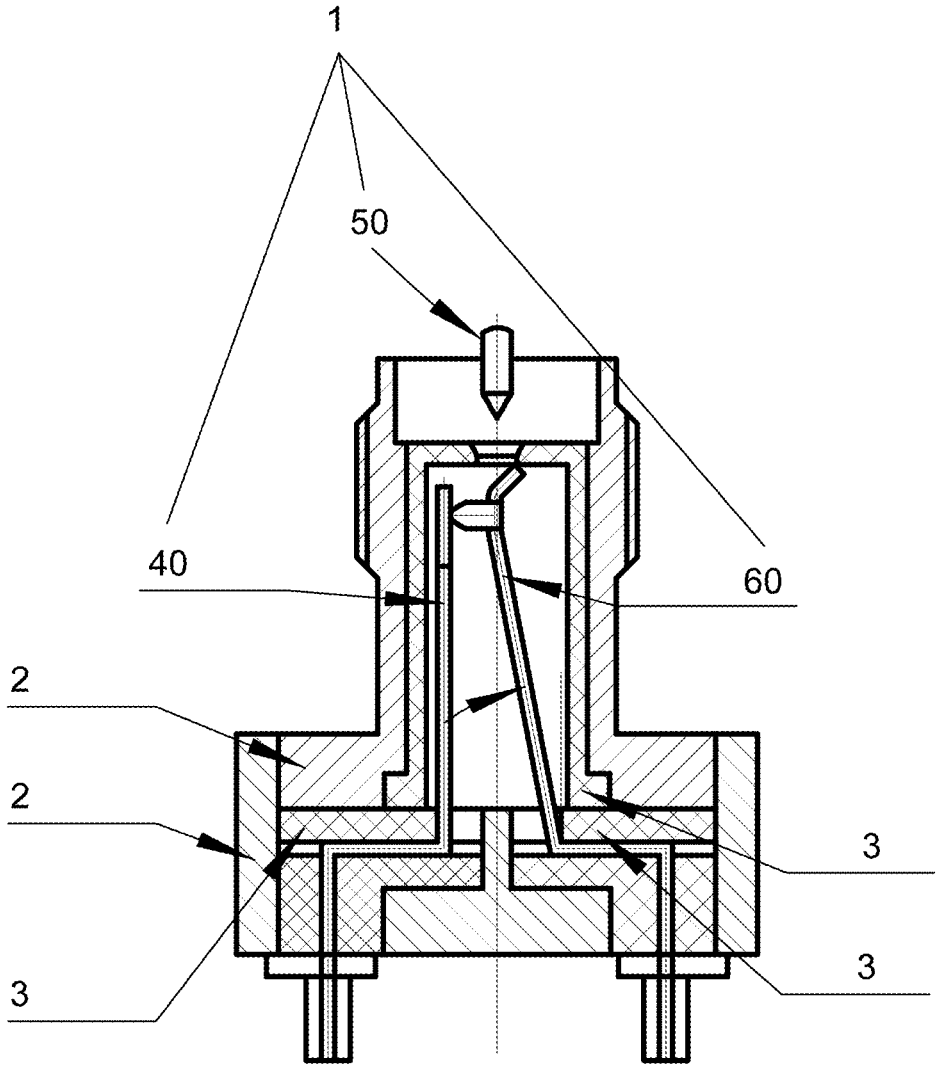
FIG. 2 is a structural schematic diagram of a connector according to an embodiment of the disclosure.

FIG. 2 is a structural schematic diagram of a connector according to an embodiment of the disclosure. As shown in FIG. 2, the connector includes an inner conductor 1, an outer conductor 2 and an insulating member 3 located between the inner conductor 1 and the outer conductor 2 and forming a non-closed cavity. An area at an opening of the non-closed cavity is a port for termination. The inner conductor 1 includes a first inner conductor 40 and an elastic inner conductor 60. The first inner conductor 40 and the elastic inner conductor 60 are arranged in the non-closed cavity; the elastic inner conductor 60 comprises an elastic member 61 having an inclinedly oriented free end portion 611 and a protrusion 612 (shown in FIGS. 4 and 5) projecting towards the first inner conductor; and in the case where the connector is unterminated, the protrusion 612 of the elastic inner conductor 60 is in contact with the first inner conductor 40, and in the case where the connector is terminated, the inclinedly oriented free end portion 611 is moved substantially laterally by a terminating conductor 50 vertically inserted through the port for termination, such that the protrusion 612 is separated from the first inner conductor 40 and the terminating conductor 50 is in contact with the elastic inner conductor 60.

In the above embodiment, one of the conductors of the inner conductor 1 of the connector is an elastic inner conductor 60. The inner conductor 1 further includes a first inner conductor 40. The elastic inner conductor 60 is selectively in contact with the first inner conductor 40 or the terminating conductor 50. Therefore, the problem of a complex structure of the connector due to the separation of the performance transmission device and the elastic device of the connector in the prior art is solved. A performance transmission device which may be integrated with the elastic device according to the connector of the embodiment of the disclosure results in less challenging part processing and finished product assembly, a simple structure, an apparent transmission route and a reliable performance and also effectively prevents the interference of the escaping signal.

The terminating conductor 50 is movably arranged vertically above the first inner conductor 40 and the elastic inner conductor 60 and may alternatively be arranged at other locations as long as the elastic inner conductor 60 can selectively be in contact with the terminating conductor 50.

Figure 3:
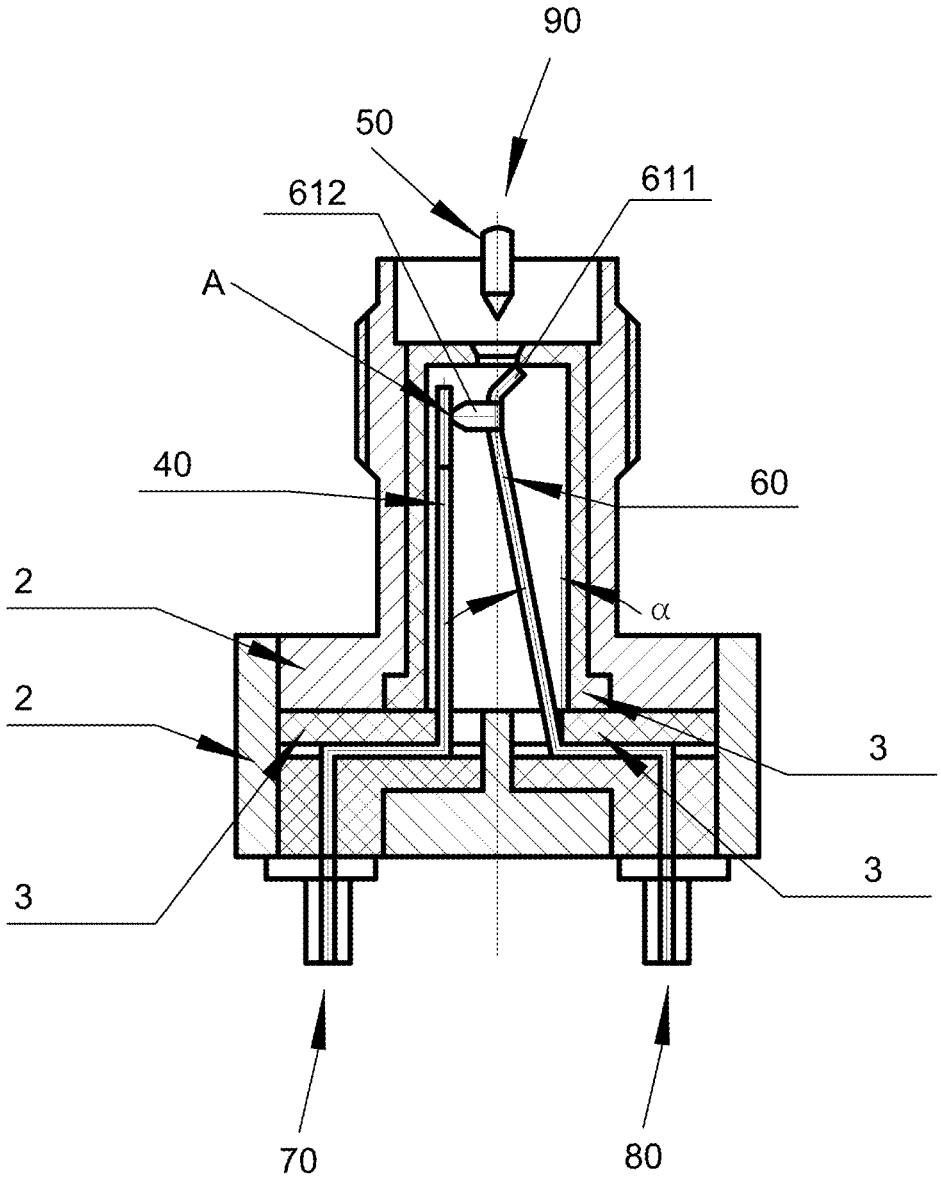
FIG. 3 is a structural schematic diagram of an unterminated connector according to an embodiment of the disclosure.

In the case where the connector is unterminated or terminated, the three conductors may be connected in different ways. Specifically, in the case where the connector is unterminated, the terminating conductor 50 is in contact with neither the first inner conductor 40 nor the elastic inner conductor 60, and the elastic inner conductor 60 is in contact with the first inner conductor 40 due to an elastic arm structure of the elastic inner conductor 60. FIG. 3 is a structural schematic diagram of an unterminated connector according to an embodiment of the disclosure. As shown in FIG. 3, the elastic inner conductor 60 is in contact with the first inner conductor 40 at an endpoint A, thus a signal pin 70 and a signal pin 80 form a closed-circuit. At the same time, the terminating conductor 50 is separated from the elastic inner conductor 60, thus the signal pin 80 and a signal source 90 form an open-circuit.

In the case where the connector is unterminated, the inclinedly oriented free end portion 611 of the elastic member 61 is located below the port for termination, such that the terminating conductor 50, when being introduced, firstly contacts an inclined surface of the free end portion 611.

In the case where the connector is terminated, the terminating conductor 50 moves towards the first inner conductor 40 and the elastic inner conductor 60 in a vertical direction of the first inner conductor 40 and the elastic inner conductor 60. The elastic inner conductor 60 is separated from the first inner conductor 40 and in contact with the terminating conductor 50. Because of an elastic arm structure of the elastic inner conductor 60, after a contact pin of the terminated connector enters into the insulator 3 on the right side of the elastic inner conductor 60, the terminating conductor 50 is in contact with the elastic inner conductor 60 and makes the elastic inner conductor 60 separated from the first inner conductor 40, such that the performance transmission device is integrated with the elastic device, and thus a port selection function is achieved, and the performance is more reliable. In addition, one of the conductors of the inner conductor of the connector is an elastic inner conductor, thus a spring device is omitted, the structure of the connector is simpler, and production and maintenance costs are saved.

In this embodiment, as shown in FIGS. 2-6, the inclinedly oriented free end portion 611 is increasingly far away from the first inner conductor 40 in a direction towards the port for termination.

Figure 4:
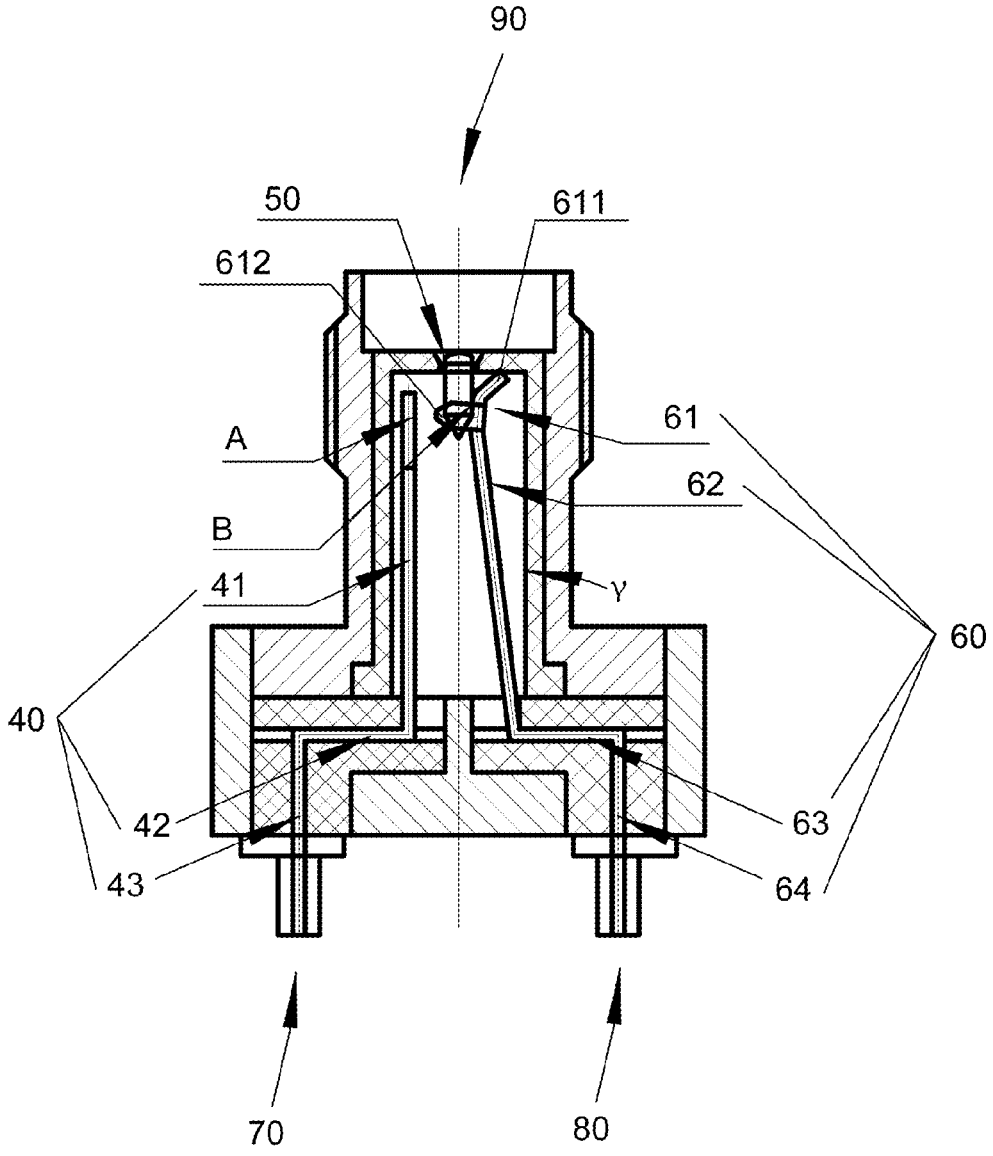
FIG. 4 is a structural schematic diagram of a terminated connector according to an embodiment of the disclosure.
Figure 5:
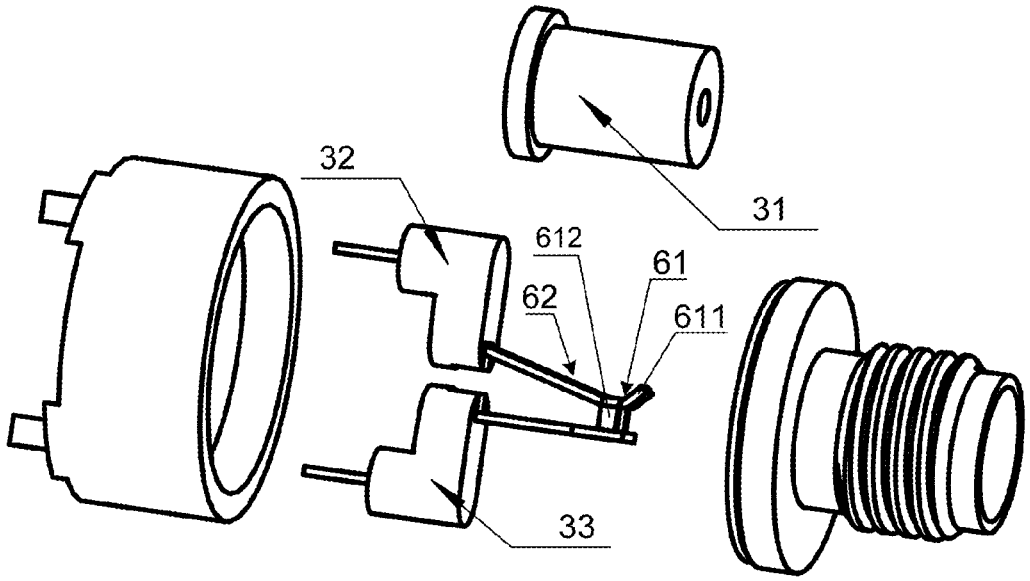
FIG. 5 is a structural schematic diagram of an insulator according to an embodiment of the disclosure.

In this embodiment, as shown in FIG. 5, a passage is provided at the protrusion 612 of the elastic member 61, and as shown in FIG. 4, in the case where the connector is terminated, the terminating conductor 50 is inserted through the passage.

In this embodiment, as shown in FIG. 5, the protrusion 612 of the elastic member 61 is formed by a pair of legs, and the passage is formed by a gap between the pair of legs.

The connector herein may be a radio frequency coaxial switch connector.

In the case where the connector is terminated, it is described in detail below how to realize a port selection function.

FIG. 4 is a structural schematic diagram of a terminated connector according to an embodiment of the disclosure. As shown in FIG. 4, the elastic inner conductor 60 includes an elastic member 61. In the case where the connector is terminated, the terminating conductor 50 is subjected to an external force, and the elastic inner conductor 60 is changed from a first state into a second state. In the first state, the elastic member 61 is in contact with the first inner conductor 40 at an endpoint A. In the second state, the elastic member 61 is separated from the first inner conductor 40 and in contact with the terminating conductor 50 at an endpoint B. The elastic member 61 may be shaped as shown in FIG. 4 or alternatively in other forms, as long as the terminating conductor 50 may be in contact with the elastic member 61 when subjected to an external force.

Shapes of the first inner conductor 40 and the elastic inner conductor 60 are not limited to those shown in FIG. 4, but may depends on actual situations. The shapes according to this embodiment are preferably shown in FIG. 4. As shown in FIG. 4, the elastic inner conductor 60 includes a first inner conductor section 62, a second inner conductor section 63 and a third inner conductor section 64. The first inner conductor section 62 is inclinedly oriented, the second inner conductor section 63 is horizontally oriented, and the third inner conductor section 64 is vertically oriented. One end of the second inner conductor section 63 is connected to the bottom end of the first inner conductor section 62, and the other end of the second inner conductor section 63 is connected to the top end of the third inner conductor section 64.

The first inner conductor 40 includes a fourth inner conductor section 41, a fifth inner conductor section 42 and a sixth inner conductor section 43. The fourth inner conductor section 41 and the sixth inner conductor section 43 are vertically oriented, and the fifth inner conductor section 42 is horizontally oriented. One end of the fifth inner conductor section 42 is connected to the bottom end of the fourth inner conductor section 41, and the other end of the fifth inner conductor section 42 is connected to the top end of the sixth inner conductor section 43.

The insulating member 3 may be manufactured by processing with mould processing, and an inner conductor is embedded in the mould. The insulating member 3 may be formed in one piece, or alternatively in a plurality of pieces depending on the actual situations. A structural schematic diagram of an insulator is shown in FIG. 5, wherein the insulator 3 includes a first insulator 31, a second insulator 32 and a third insulator 33. The first insulator 31 is located outside the first inner conductor section 62 and the fourth inner conductor section 41; the second insulator 32 is located outside the second inner conductor section 63 and the third inner conductor section 64; and the third insulator 33 is located outside the fifth inner conductor section 42 and the sixth inner conductor section 43.

Figure 6:
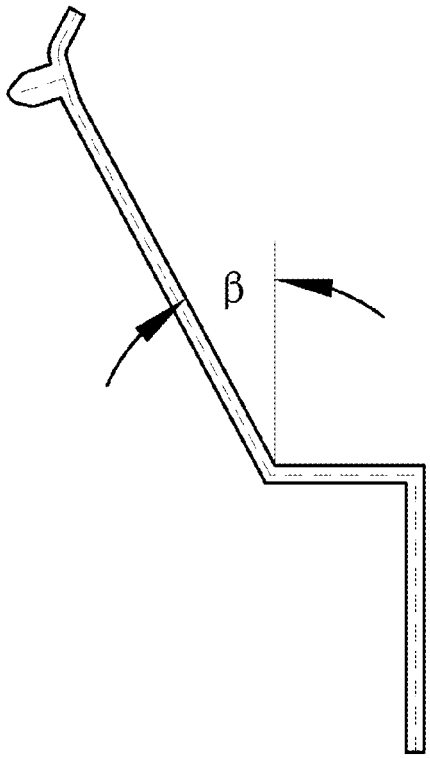
FIG. 6 is a structural schematic diagram of an elastic inner conductor according to an embodiment of the disclosure.

FIG. 6 is a structural schematic diagram of an elastic inner conductor according to an embodiment of the disclosure. As shown in FIG. 6, an angle of inclination of the second inner conductor section 63 of the elastic inner conductor 60 in a free state with respect to the vertical direction is $\beta$. The angle of inclination in FIG. 3 is changed into $\alpha$. When $\alpha$ is smaller than $\beta$, a certain elastic potential energy would be accumulated, so that the first inner conductor 40 is firmly in contact with the elastic inner conductor 60 at an endpoint A, and a signal connection between the first inner conductor 40 and the elastic inner conductor 60 is accomplished. In this case, a signal pin 70 and a signal pin 80 forms a closed-circuit, and a signal source 90 and the signal pin 80 forms an open circuit.

In the case where the connector is terminated, as shown in FIG. 4, due to an elastic arm of the elastic inner conductor 60, when the terminating conductor 50 enters into the port for termination, the angle of inclination is further reduced from $\alpha$ to $\gamma$. In this case, more elastic potential energy is accumulated, such that the terminating conductor 50 is firmly in contact with the elastic inner conductor 60 at an endpoint B, and a signal connection between the terminating conductor 50 and the elastic inner conductor 60 is accomplished. At this time, due to the reduction of the deflection angle $\alpha$, the connection is created at the endpoint B instead of the endpoint A, thus the signal pin 70 and the signal pin 80 form an open-circuit, and the signal source 90 and the signal pin 80 form a closed-circuit.

It can be seen from the above description, the embodiment of the disclosure provides a connector, which preferably is a radio frequency coaxial switch connector. The connector combines the functions of the electrical transmission and elastic arrangement by integrating the performance transmission device and the elastic device, has a firm and stable contact structure, a simple structure and a reliable performance, and prevents the interference of the escaping signal. With the technical solution provided by the embodiment of the disclosure, the connector is very simple in structure, apparent in transmission route, less challenging in part processing and finished product assembly, promising in market prospects, and favorable in social and economic benefits.

The disclosure is described with the preferred embodiments and is not intended to limit the scope of the disclosure.

Any variations, equivalent substitutions and modifications made within the spirit and scope of the disclosure fall in the scope of the disclosure.

INDUSTRIAL APPLICABILITY

In an embodiment of the disclosure, a connector includes an inner conductor, an outer conductor and an insulating member located between the inner conductor and the outer conductor and forming a non-closed cavity. An area at an opening of the non-closed cavity is a port for termination. The inner conductor includes a first inner conductor and an elastic inner conductor, wherein the first inner conductor and the elastic inner conductor are arranged in the non-closed cavity; the elastic inner conductor comprises an elastic member having an inclinedly oriented free end portion and a protrusion projecting towards the first inner conductor; and in the case where the connector is unterminated, the protrusion of the elastic inner conductor is in contact with the first inner conductor, and in the case where the connector is terminated, the inclinedly oriented free end portion is moved substantially laterally by a terminating conductor vertically inserted through the port for termination, such that the protrusion is separated from the first inner conductor and the terminating conductor is in contact with the elastic inner conductor. The connector prevents the problem of complex structure of the connector due to the separation of the performance transmission device and the elastic device of the connector present in the prior art.

The invention claimed is:

1. A connector, comprising:

an inner conductor (1);

an outer conductor (2); and an insulating member (3), located between the inner conductor (1) and the outer conductor (2) and forming a non-closed cavity, wherein an area at an opening of the non-closed cavity is a port for termination, wherein the inner conductor (1) comprises a first inner conductor (40) and an elastic inner conductor (60), wherein the first inner conductor (40) and the elastic inner conductor (60) are arranged in the non-closed cavity, wherein the elastic inner conductor (60) comprises an elastic member (61) having a straight inclinedly oriented free end portion (611) and a protrusion (612) projecting towards the first inner conductor (40) and formed by a pair of legs, between which a passage is provided, and wherein in the case where the connector is unterminated, the protrusion (612) of the elastic inner conductor (60) is in contact with the first inner conductor (40), and in the case where the connector is terminated, the inclinedly oriented free end portion (611) is moved substantially laterally by a terminating conductor (50) vertically inserted through the port for termination and through the passage between the pair of legs of the elastic inner conductor (60), such that the protrusion (612) is separated from the first inner conductor (40) and the terminating conductor (50) is in contact with the elastic inner conductor (60).

2. The connector according to claim 1, wherein in the case where the connector is terminated, the terminating conductor (50) moves towards the first inner conductor (40) and the elastic inner conductor (60) in a vertical direction of the first inner conductor (40) and the elastic inner conductor (60), until the elastic inner conductor (60) is separated from the first inner conductor (40) and the elastic inner conductor (60) is in contact with the terminating conductor (50).

3. The connector according to claim 1, wherein in the case where the connector is unterminated, the inclinedly oriented free end portion (611) of the elastic member (61) is located below the port for termination, such that the terminating conductor (50), when being introduced, firstly contacts an inclined surface of the free end portion (611).

4. The connector according to claim 2, wherein in the case where the connector is terminated, the terminating conductor (50) is subjected to an external force, and the elastic inner conductor (60) is changed from a first state into a second state, wherein in the first state, the elastic member (61) is in contact with the first inner conductor (40), and in the second state, the elastic member (61) is separated from the first inner conductor (40) and in contact with the terminating conductor (50).

5. The connector according to claim 1, wherein the inclinedly oriented free end portion (611) is increasingly far away from the first inner conductor (40) in a direction towards the port for termination.

6. The connector according to claim 1, wherein the elastic inner conductor (60) comprises a first inner conductor section (62), a conductor section (63) and a third inner conductor section (64), wherein the first inner conductor section (62) is inclinedly oriented, the second inner conductor section (63) is horizontally oriented, and the third conductor section (64) is vertically oriented, wherein one end of the conductor section (63) is connected to the bottom end of the first inner conductor section (62), and the other end of the second inner conductor section (63) is connected to the top end of the third inner conductor section (64).

7. The connector according to claim 1, wherein the first inner conductor (40) comprises a fourth inner conductor section (41), a fifth inner conductor section (42) and a sixth inner conductor section (43), wherein the fourth inner conductor section (41) and the sixth inner conductor section (43) are vertically oriented, and the fifth inner conductor section (42) is horizontally arranged, wherein one end of the fifth inner conductor section (42) is connected to the bottom end of the fourth inner conductor section (41), and the other end of the fifth inner conductor section (42) is connected to the top end of the sixth inner conductor section (43).

8. The connector according to claim 6, wherein the insulating member (3) comprises a first insulator (31), a second insulator (32) and a third insulator (33), wherein the first insulator (31) is located outside the first inner conductor section (62), and the second insulator (32) is located outside the conductor section (63) and the third inner conductor section (64).

9. The connector according to claim 7, wherein the insulating member (3) comprises a first insulator (31), a second insulator (32) and a third insulator (33), wherein the first insulator (31) is located outside the fourth inner conductor section (41), and the third insulator (33) is located outside the fifth inner conductor section (42) and the sixth inner conductor section (43).

10. The connector according to claim 1, wherein the insulating member (3) is manufactured by mould processing.

11. The connector according to claim 1, wherein the connector is a radio frequency coaxial switch connector.

* * * * *